United States Patent [19]

Justus

[11] 4,231,434

[45] Nov. 4, 1980

[54] HYDRAULIC IMPACT DEVICE

[76] Inventor: Edgar J. Justus, 1826 Sherwood Dr., Beloit, Wis. 53511

[21] Appl. No.: 879,216

[22] Filed: Feb. 21, 1978

[51] Int. Cl.[3] ..... B25D 9/02; F01B 7/18

[52] U.S. Cl. ..... 173/119; 91/276; 91/321; 173/134; 173/DIG. 4

[58] Field of Search ..... 91/50, 165, 276, 286, 91/317, 321, 325, 328, 341 R; 173/119, 134, DIG. 4

[56] References Cited

U.S. PATENT DOCUMENTS

| | | | |
|---|---|---|---|
| 3,664,435 | 5/1972 | Klessig | 173/17 |
| 3,687,008 | 8/1972 | Densmore | 173/DIG. 4 |
| 3,766,830 | 10/1973 | Montebert | 173/DIG. 4 |
| 3,827,507 | 8/1974 | Lance | 173/119 X |
| 3,866,690 | 2/1975 | Lance et al. | 173/119 X |
| 3,887,019 | 6/1975 | Reynolds et al. | 91/321 X |
| 3,908,373 | 9/1975 | Peterson | 91/321 X |
| 3,925,985 | 12/1975 | Peterson | 173/DIG. 4 |
| 4,018,135 | 4/1977 | Lance et al. | 91/321 |

*Primary Examiner*—Lawrence J. Staab
*Attorney, Agent, or Firm*—Dirk J. Veneman

[57] ABSTRACT

A hydraulic impact device in which a hammer member having a piston portion is reciprocally disposed in a cylinder, a reciprocating sleeve valve is disposed within the cylinder and surrounds the hammer member. The sleeve valve has a first peripheral seal with an upper portion of the cylinder and a second peripheral seal with the lower portion of the cylinder so that an annular cavity is formed between the first and the second peripheral seals. The bottom portion of the sleeve valve forms a single seal with the upper portion of the piston section. A pressure relief valve is situated between the inlet to said annular cavity and an annular cavity below the piston portion to insure that the pressure in said annular cavity is greater than the pressure in the cavity below the piston portion and the sleeve valve thus effecting a sealing force between the sleeve valve and the upper face of the piston portion. An energy storage means is provided for receiving energy from said ram member during its upward stroke. The upper and lower sealing portions of said sleeve valve are axially spaced such that when said lower sealing portion seals a fluid inlet port, the upper sealing portion opens a fluid outlet port thereby reducing the pressure in said annular cavity by interrupting a fluid communication between the inlet port and said annular cavity and establishing fluid communication between the outlet port and said annular cavity.

6 Claims, 8 Drawing Figures

HYDRAULIC IMPACT DEVICE

BACKGROUND OF THE INVENTION

The present invention relates to a hydraulically powered repetitive impact device and more specifically to a hydraulic demolition hammer.

Such devices serve to deliver successive blows to a variety of tools in order to disintegrate concrete, rock or other materials or for performing work requiring repetitive impact blows, such as riveting and hammering.

Repetitive impact devices are well known in the prior art and have heretofore been predominately driven by air pressure. Lately, several of these devices have been driven hydraulically by oil pressure, but these hydraulically driven devices are notorious for their complexity, requiring a large number of moving parts which makes maintenance expensive, frequent and cumbersome.

Typical examples of such prior art devices are shown in U.S. Pat. Nos. 4,018,135; 3,866,690; 3,827,507; 3,766,830; 3,687,008 and 3,664,435.

Of these prior art devices, U.S. Pat. No. 4,018,135 is perhaps the most typical and one skilled in the art will immediately observe the complex nature of its design requiring intricate machining and sealing operations because of its designer's insistance on using only two hydraulic pressures and of having effective hydraulic areas proportioned such that hydraulic fluid continually biases the sleeve valve toward the piston portion of the hammer member to tend to maintain sealing engagement between the sleeve valve and the piston portion.

In contrast, the present invention has as its principal object, the provision of a hydraulic hammer which has an absolute minimum number of moving parts as compared to prior art devices and which effectively utilizes a multiplicity of hydraulic pressures to eliminate intricately machined moving parts.

It is a further object of the present invention to provide a hydraulic hammer which can deliver an impact force which is from three to ten times higher than other such devices presently being marketed.

A still further object of the present invention is to provide a hydraulic hammer which has an adjustable impact energy.

A still further object of the present invention is to provide a hydraulic hammer which is self-lubricating, thus decreasing maintenance requirements.

Other objects, advantages and features, as well as equivalent structures and methods which are intended to be covered herein, will become more apparent with the teaching of the principles of the invention in connection with the disclosure of the preferred embodiment thereof in the specification, claims and drawings, in which:

DESCRIPTION

Figure 1:
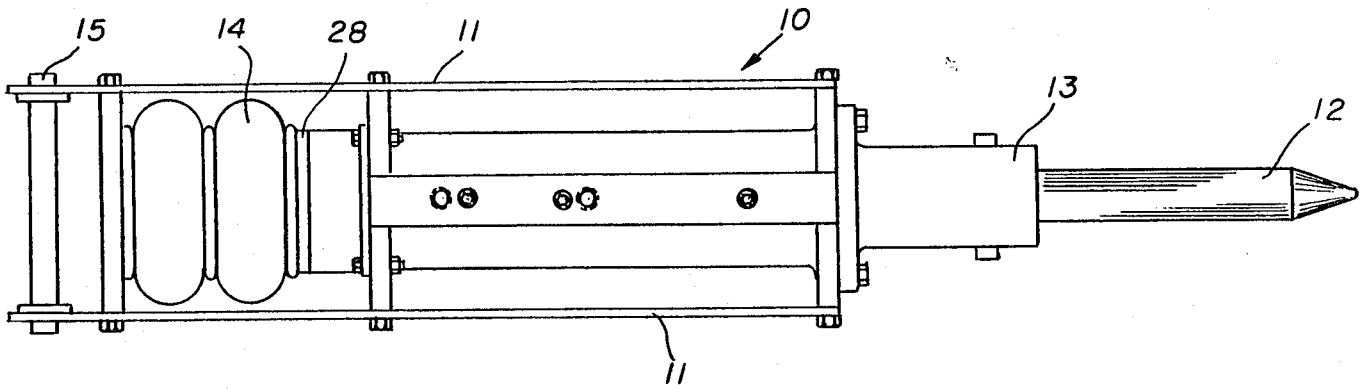
FIG. 1 is a plan view showing the external parts of the present invention.

As illustrated in FIG. 1, the hammer 10 is supported by mounting plates 11 and the moil point 12 is supported by toolholder 13. An air spring 14 is located between a driver plate 28 and mounting plate 29.

Figure 2:
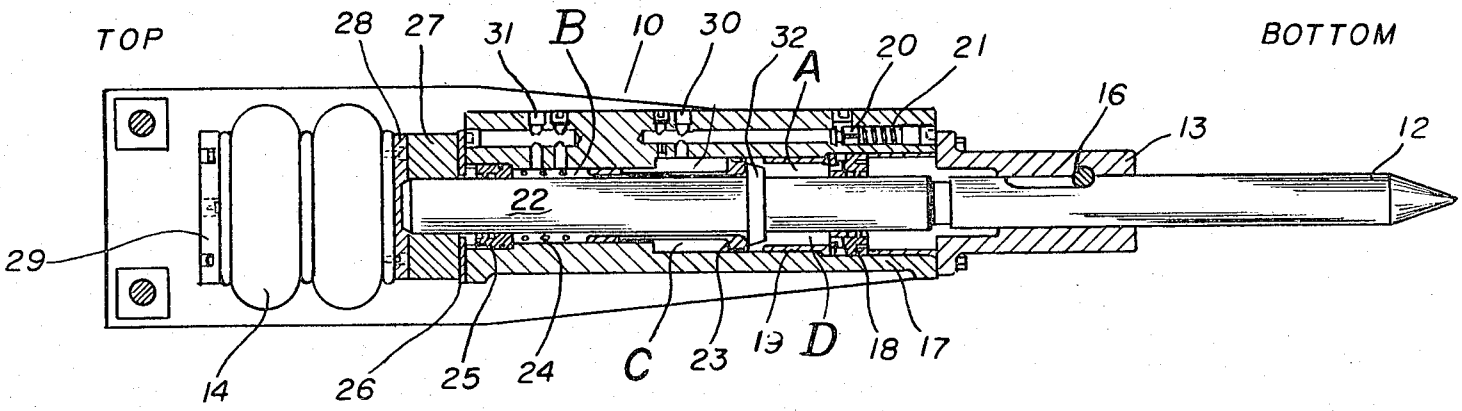
FIG. 2 is a cross-sectional view of the structure shown in FIG. 1.

Referring now to FIG. 2, the hammer 10 comprises moil 12 mounted in a toolholder 13 by means of a retaining pin 16. A hammer housing 17 contains a ram 22 mounted for slidable movement therein by means of upper and lower glands or bearings 25 and 18, respectively. The housing 17 has a stepped or two-diameter bore providing for two annular chambers A and B between the glands 25 and 18. The ram 22 has a piston portion 32. Above or to the left of the piston portion 32 is a sleeve valve 23 slidably mounted in the annular chambers A and B, respectively. The piston portion 32 together with the lower portion of the sleeve valve 23 divides the annular chamber A into two chambers B and D. The chamber D contains a dampener sleeve 19 while the chamber B contains a starter spring 24 mounted between the sleeve valve 23 and the upper bearing 25. The upper bearing 25 is retained in the housing 17 by means of a bearing retainer plate 26. An elastomeric bumper 27 is mounted between the bearing retainer plate 26 and a driver plate 28. An inflatable air spring 14 is mounted between the driver plate 28 and a mounting plate 29. Inlet and outlet oil passages 30 and 31, respectively, are provided as well as a relief valve 20, the function of which will be described in more detail hereinafter.

The hammer may readily be attached to the backhoe of a tractor by means of mounting pin 15 and the tractor's hydraulic oil pressure system may be readily attached to oil inlet and outlet 30 and 31, through suitable valving.

Figure 3:
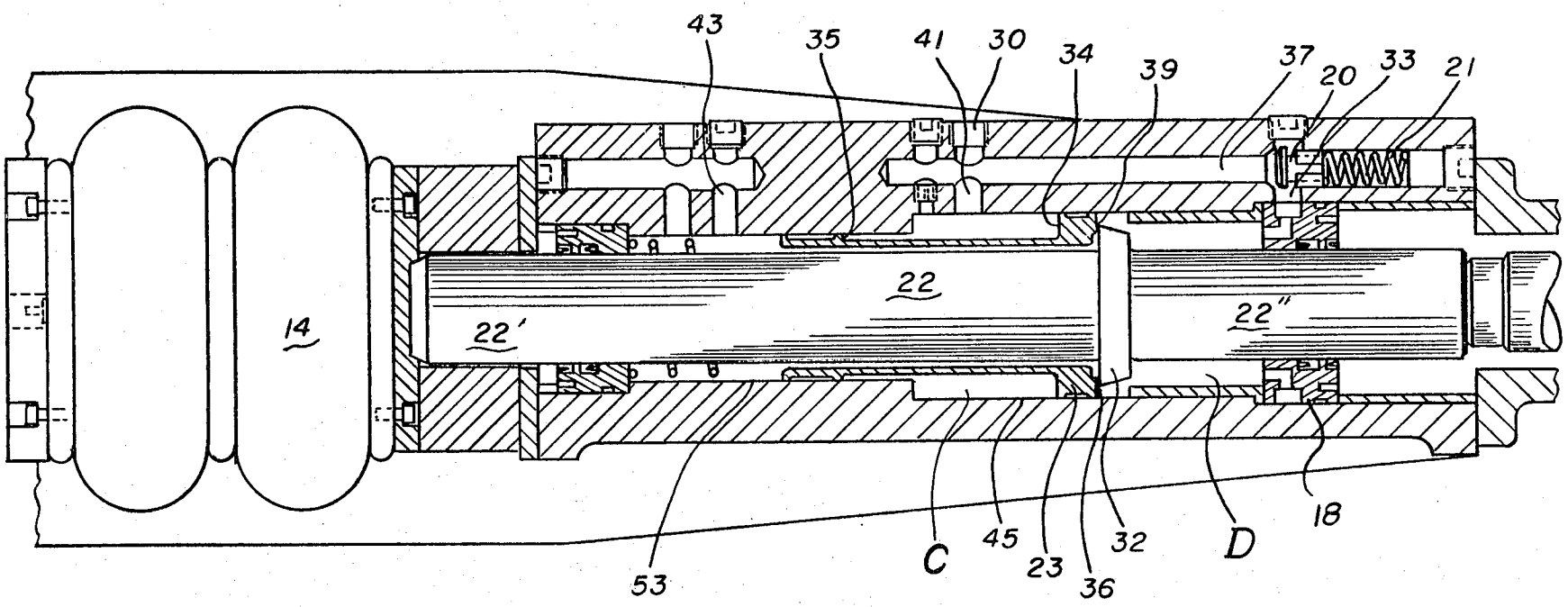
FIG. 3 is an enlarged partial cross-sectional view of the hydraulic hammer shown at the beginning at its compression stroke.

Referring now to FIG. 3, in operation, high pressure oil enters the supply port 30 which communicates with the annular space C around the outside of the sleeve valve 23. The differential areas on the sleeve valve causes it to be driven downward to seat on the flange of the piston 32 on the ram 22. When the sleeve valve 23 is sealed to the piston 32, the high pressure oil is forced to the relief valve 20. The relief valve 20 is biased by a spring 21 and the high pressure oil forces it to open causing the oil to flow through lower bearing 18 and into the chamber D below the piston 32. The differential area represented by the two opposed surfaces 34 and 35 of the sleeve valve exposed to annular space C and the differential pressure established by the relief valve between space C and space D maintain the sleeve valve 23 seated on the piston 32. The piston and sleeve are thus driven upwardly with the ram 22 compressing the air spring 14 by the pressure in space D acting on an effective area equal to the difference of the area of the smaller upper bore and the cross-sectional area of the ram (see FIG. 4). After the ram 22 has risen a predetermined distance, the sleeve valve's outside diameters or sealing rings act to simultaneously close off the oil supply port 41 (FIG. 4) and to simultaneously open the oil outlet port 43. This action causes the oil pressure in annular area C to drop precipitously which reverses the bias of the sleeve valve 23 toward the piston 32 and the sleeve valve is caused to lift from the piston.

One of the unique and novel features of this invention is the utilization of the pressure relief valve 20, by means of which the piston portion 32 is maintained in sealing engagement with the lower portion of the sleeve valve 23 and by means of which at the end of the upward stroke of the ram the full flow of oil is diverted to translate the sleeve valve 23 downwardly into sealing engagement with piston portion 32 on ram 22 in the shortest possible time in order to reduce the cycle time to a minimum. The piston 32 with the ram 22 is then driven downwardly through the oil by the compressed air spring 14. The elastomeric bumper 27 acts as a bottom stop for the air spring 14 and driver plate 28. The ram 22 strikes the moil point 12 and its kinetic energy is transferred to the work surface. The sleeve valve 23 is then brought back down to sealing relation to the ram by the action of the spring 24 and the supply pressure after which the cycle is repeated.

The operation of the device of the present invention is shown in more complete detail in FIGS. 3 through 6.

FIG. 3 shows the ram 22 at the beginning of the compression stroke. The sleeve valve 23 is pushed against the piston portion 32 of the ram 22 by high pressure oil introduced into the inlet opening 30 via channel 41 into the annular area C and acting upon the areas 34 and 35 of the sleeve valve 23. When sealing surface 36 on the sleeve valve 23 contacts the piston portion 32, the annular space C can no longer expand and the oil pressure in the passage 37 increases and moves the pressure relief valve 20 off its seat thus allowing oil at a reduced pressure to flow into the annular space D through port 33. The difference between areas 34 and 35 biases or urges the sleeve valve 23 into sealing relationship with the piston portion 32 on the ram 22. The unseating force against area 39 on the portion of the sleeve 23 exposed to the reduced pressure in annular space D is exceeded by the force in the annular space or sealing annulus C against areas 34 and 35, thus maintaining the seal. The net result is that the force in the annular space or compression annulus D acting on the piston 32 and the exposed portion 39 of the sleeve valve 23 cause the ram 22 to rise thus compressing air spring 14. This compression stroke continues until the condition shown in FIG. 4 is reached.

Figure 4:
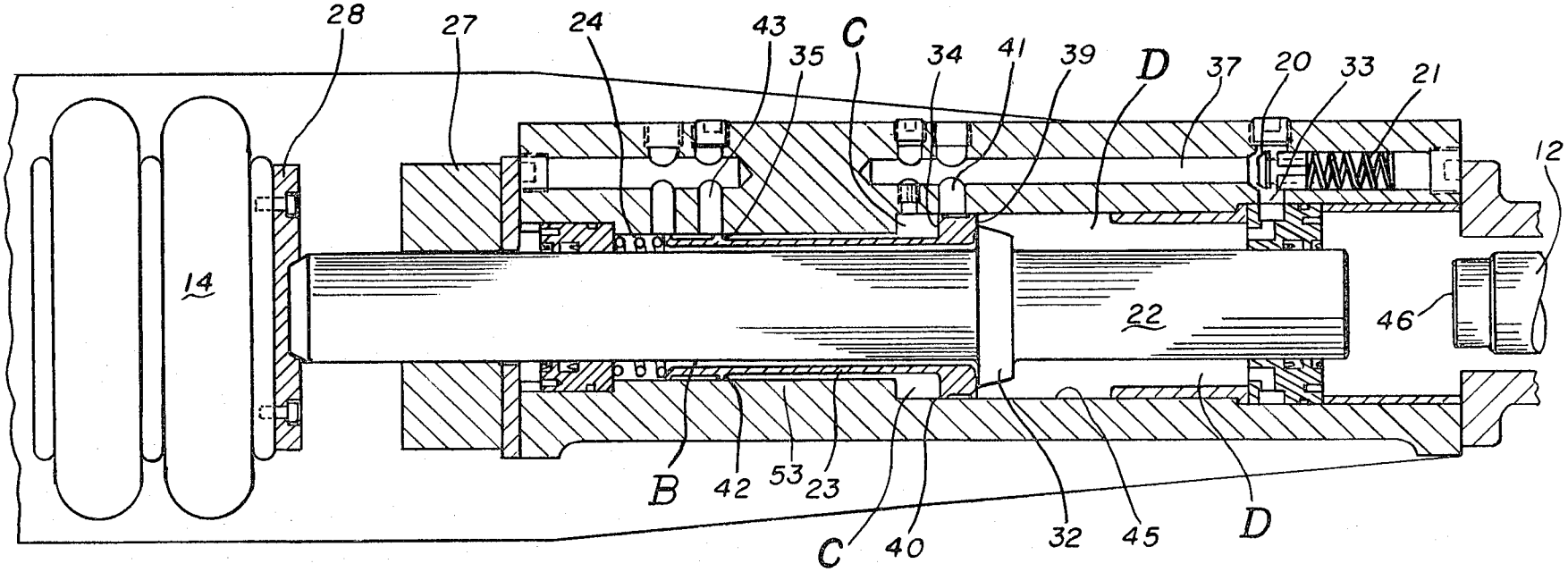
FIG. 4 is an enlarged partial cross-sectional view showing the hydraulic hammer at the moment of triggering of the impact stroke.

As shown in FIG. 4, the ram 22 has reached the end of its upward stroke and the air spring 14 is now fully compressed by virture of the ram 22 pressing on the air spring driver plate 28. At this point shown in FIG. 4, the upper edge 40 of the bottom sealing diameter of the sleeve valve 23 is just closing off entrance port 41 from the annular space C. Simultaneously the lower sealing edge 42 of the upper sealing diameter of sleeve valve 23 is just opening the annular space C to the discharge or drain port 43. The simultanenous closing of port 41 and opening of port 43 suddenly reduces the pressure in the annular space C, thus reducing the biasing force of areas 34 and 35 on the sleeve valve 23 towards the piston portion 32. The pressure in the annular space D acting on area 39 causes the sleeve valve 23 to lift off the piston 32 permitting the oil in annular space D to be drained into annular space B and causing an almost instantaneous drop in pressure in annular space D. The air spring 14 can now drive the ram 22 downwardly through the oil in the compression chamber or annular space D. The oil in the chamber D bypasses around the clearance established between the piston 32 and the bore 45. The ram 22 continues downwardly accelerated by the force of the spring 14 until it hits the anvil end 46 of the moil 12 thus imparting the kinetic energy of the ram 22 to the moil 12, as shown in FIG. 5.

Figure 5:
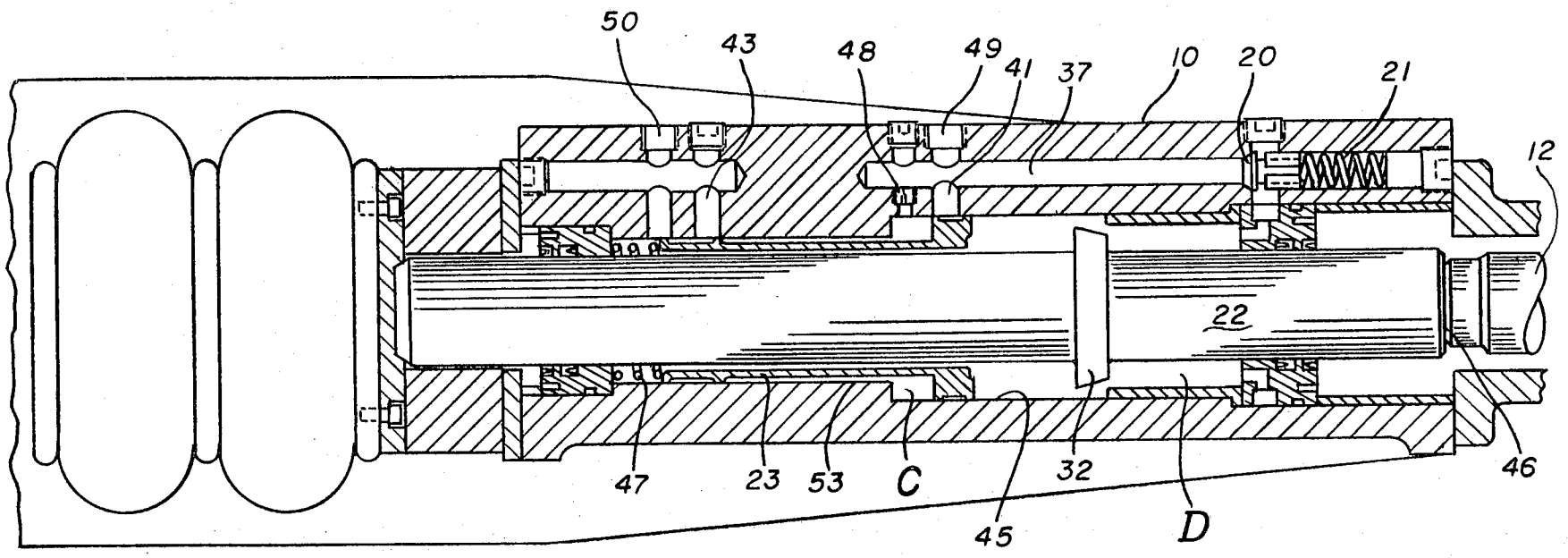
FIG. 5 is an enlarged partial cross-sectional view showing the hydraulic hammer at the moment of impact.

In FIG. 5, the hammer 10 is shown shortly after the ram 22 has impacted on the moil 12. The starter spring 47 now urges the sleeve valve 23 downwardly. Oil is permitted to flow through starter orifice 48 to assist the spring 47 in urging the sleeve valve 23 downwardly. A very small downward movement of the sleeve valve 23 again closes the discharge port 43 and opens supply port 41 so that through port 41 high pressure oil can again enter the annular space C. The sleeve valve 23 moves freely so that the pressure in oil supply passage 37 drops causing the relief valve 20 to close. When the relief valve 20 is closed, all of the supply oil flow is utilized to move the sleeve valve 23 downwardly toward the piston portion 32 on ram 22. By utilizing the relief valve 20, it will be appreciated that the fastest possible cycle time and the most effective sealing of the sleeve valve 23 on piston 32 is facilitated because the pressure in annular space C is maintained higher than the pressure in annular space D except for the triggering action.

Figure 6:
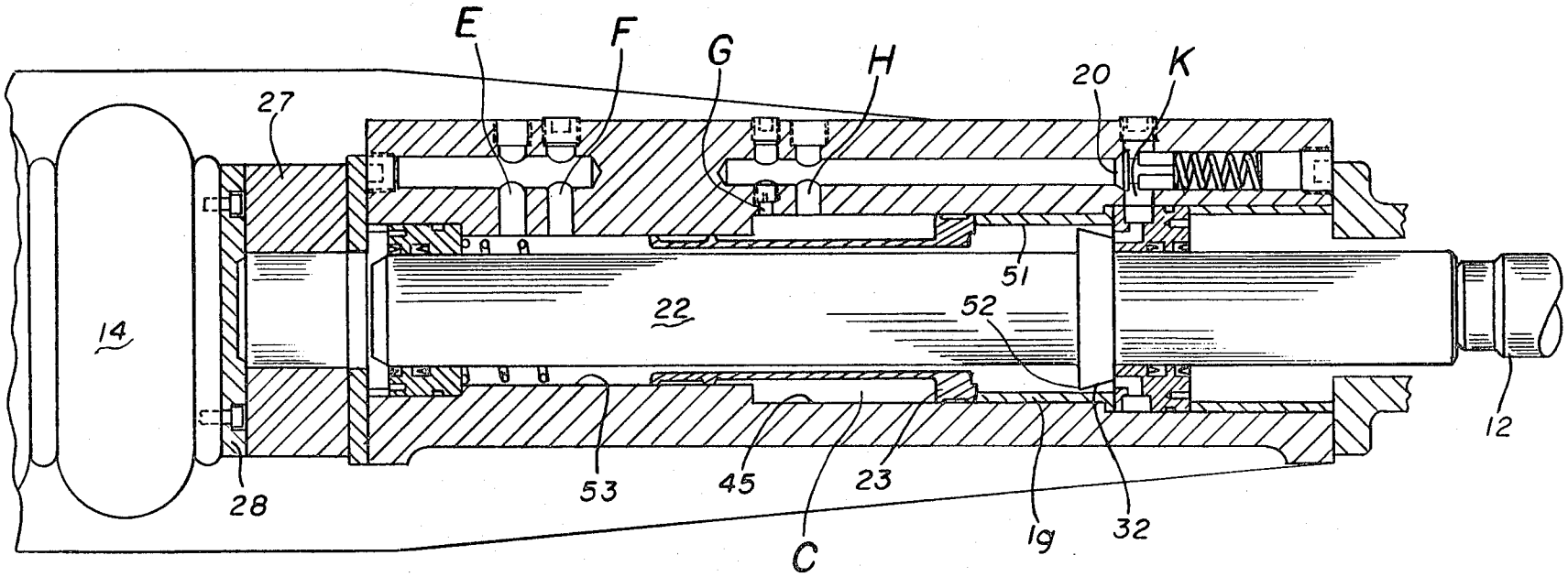
FIG. 6 is an enlarged partial cross-sectional view of the hydraulic hammer showing the position of the ram and sleeve valve when there is no preload on the tip of the tool.

Additional features of the invention are illustrated in FIG. 6. It will be noted that there is no mechanical connection between the ram 22 and the driver plate 28. The driver plate 28 and the air spring 14 are limited in downward travel by the elastomeric bumper 27. When the moil 12 is in a downward position, as shown in FIG. 6, the ram 22 and the piston portion 32 enter into a dampening bushing 19 which, as is common practice on commercial hydraulic cylinders, has a tapered bore 51. Oil is forced to flow through the gradually reducing annular clearance 52 thus snubbing or dampening any rapid movement of the ram 22 after the piston portion 32 enters the dampening bushing 19. The upper edge of the dampening bushing 19 acts as a downward stop for the sleeve valve 23 thus keeping it in engagement with the upper bore 53 at all times.

As shown in FIG. 6, there are five openings in the housing 17 for the flow of oil. Opening E is a discharge or drain opening, opening F is also a discharge or drain port subject to being opened and closed by axial movement of the sleeve valve 23. Opening G is a small diameter orifice delivering a reduced pressure or flow into the sealing annulus C. Its purpose is to supply sufficient oil to cause the sleeve valve 23 to move to close port F and open H after the ram has been triggered. Port H emits high pressure and flow of oil to translate the sleeve valve 23 and to cause it to seal on the piston portion 32. Port K receives oil through the relief valve 20 to supply the main oil flow to move ram 22 upwardly and to thus press the energy absorbing air spring 14.

Figures 7, 8:
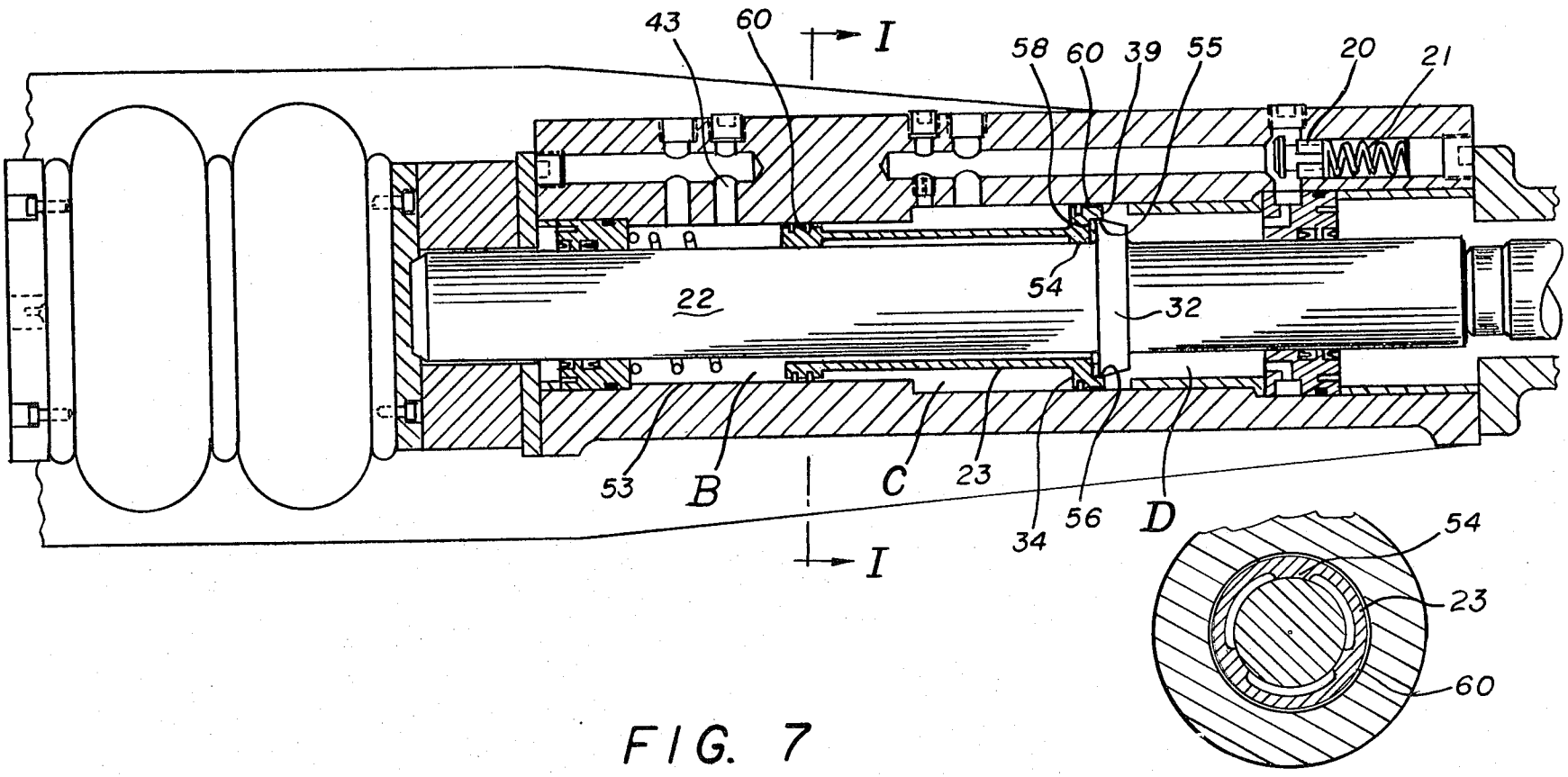
FIG. 7 is an enlarged partial cross-sectional view showing an alternate embodiment of the present invention.
FIG. 8 is a partial cross-sectional view taken along lines I—I of FIG. 7.

Another embodiment of the invention is shown in FIG. 7 and utilizes a different mode of sealing and of locating the sleeve valve 23. In this arrangement, the sleeve valve 23 is provided with internal support surfaces 54 which radially locate it to the ram 22 and permit the sleeve valve 23 to slide axially on the ram. There is a cup-shaped portion 55 on the lower surface of the sleeve valve 23. The inside diameter of the cup portion 55 is a very few one thousandths of an inch larger than the O.D. 56 of the piston portion 32 of the ram 22. When the cup portion 55 slides over the piston portion 32, it makes a seal separating annulus D from annulus B. The unique method of locating the sleeve 23 from the ram itself and the provision for relatively large clearance between the sleeve valve 23 and the bores 53 and 45 prevents hangup of the sleeve valve 23 during cold weather when suddenly hot oil may be pumped into the hammer, causing the sleeve valve 23 to expand before the larger mass of the housing 17 can expand.

Another advantage of mounting the sleeve valve 23 directly from the ram 22 is to eliminate any problems from any concentricity errors that might exist between the two bores 53 and 45 of the housing 17 and between the I.D. and O.D. of the bearings 18 and 25. By eliminating possible error from these aforementioned sources, the clearance between the piston 32 and the I.D. of the cup portion 55 on the bottom of the sleeve valve 23 may be made very small effecting a better seal. There is no seal between the sleeve valve 23 and the top portion of the piston 32 which acts only as a downward stop for the sleeve valve 23. The vent grooves and milled slots 58 in the face of the sleeve valve 23 abutting against the top of the piston portion 32 prevent any seal action from the top surface.

A very important advantage is thus gained in that the annular sealing area 39 is thus very finitely defined as that between the larger bore 45 and the O.D. of the piston portion 56. In those systems using the top face of the piston portion 32 there is an indeterminate area or force from the sealing area because the actual sealing area has some radial width with indeterminate pressure gradient acting on this sealing area.

In this particular embodiment of the invention, the O.D. of the piston area 56, the I.D. of the smaller upper bore 53, and the I.D. 55 of the cup portion of the sleeve valve may, actually coincide. This arrangement also permits the O.D. of the piston 56 to be smaller than when the top portion is used for sealing and thus permits a greater annular clearance for bypass of oil during the impact stroke. This permits greater energy impact per blow.

The actual net force on the sleeve valve 23 keeping it in sealing engagement with the piston portion 32, when the area 34 pushing down is equal to the area 39 pushing up, is effected by the pressure differential caused by the pressure relief valve 20. This difference in pressure between annular space C and D causes the force pushing down on the sleeve valve annular area 34 to exceed that pushing up on the sleeve valve from annular area 39 from below. Thus, with equal areas opposing each other, the greater pressure from above causes a greater force, which causes the valve 23 to stay in sealing arrangement against the piston 32 until the triggering action occurs as previously described.

In order to permit greater radial clearances 60 between the sleeve valve 23 and the upper and lower bores, 53 and 57 respectively, without undue leakage, sealing-type piston rings 59 may be used.

What is claimed is:

1. A hydraulic impact device comprising a housing having a cylindrical bore comprising an upper and a lower portion, said upper portion having a diameter smaller than the diameter of the lower portion, upper and lower bearing means mounted in the upper and lower end portions of said cylindrical bore respectively, a ram member reciprocally disposed in said housing having upper and lower portions sealingly received in said upper and lower bearing means respectively, said ram member including a piston portion having a diameter smaller than the diameter of the lower portion of said cylindrical bore to permit fluid to bypass the piston within the cylindrical bore,a sleeve valve reciprocally disposed in the cylinder bore, said sleeve valve having a small diameter upper radial outer sealing portion for sealingly engaging the diameter of said upper portion of said cylindrical bore and having a large diameter lower radial outer sealing portion for sealingly engaging the diameter of said lower portion of said cylindrical bore, said sleeve valve further including a lower annular sealing portion for sealingly engaging the upper annular portion of said piston portion thereby dividing said cylindrical bore into upper, intermediate and lower annular chambers, a hydraulic fluid inlet port for supplying high pressure fluid to said intermediate chamber to force said lower annular sealing portion into sealing engagement with the upper annular portion of said piston portion, a pressure relief valve positioned between said high pressure fluid inlet port and a lower hydraulic fluid inlet port for delivering to the lower annular chamber a presure lower than the pressure in said intermediate annular chamber so as to effect a force bias of said sleeve valve toward said piston portion and to divert oil flow to the intermediate annular chamber when the pressure in said intermediate annular chamber is reduced thereby returning said sleeve valve to sealing engagement with said piston portion, energy storage means attached to the upper portion of said housing for receiving energy from said ram member during its upward stroke, a hydraulic fluid outlet port for exhausting fluid from the upper and intermediate annular chambers, said upper and lower radial sealing portions of said sleeve valve being axially spaced such that when said lower sealing portion seals the fluid inlet port the upper sealing portion opens the fluid outlet port thereby reducing the pressure in said intermediate chamber by interrupting fluid communication between said inlet port and said intermediate annular chamber and establishing fluid communication between said outlet port and said intermediate annular chamber thereby unseating the sleeve valve and permitting said ram member to be driven downwardly by said energy storage means.

2. The device of claim 1 wherein said sleeve valve further includes upper and lower inner radial support surfaces for radially locating said sleeve valve with respect to said ram member.

3. The device of claim 1 wherein said lower annular sealing portion of said sleeve valve comprises a cup-shaped portion having an inside diameter for sealingly engaging the outside diameter of said piston portion.

4. A hydraulic impact device comprising:

a cylinder member having a lower gland portion, a center portion having a stepped bore with an upper section having a diameter less than a lower section, and an upper gland portion, a hammer member reciprocally disposed in the cylinder having lower and upper shaft portions slidably and sealingly received in the lower and upper gland portions, respectively, and a piston portion disposed generally in the center portion, the piston portion having a diameter less than the maximum diameter of the stepped bore to permit fluid to bypass the piston within the bore and permit the hammer member to be driven downwardly by an external biasing force, a sleeve valve reciprocally disposed within the cylinder member around the upper shaft portion, the sleeve valve having a first peripheral seal with the upper section of the stepped bore and a second peripheral seal with the lower section of the stepped bore to form an annular cavity between the first and second peripheral seals the sleeve valve and the cylinder member, said annular cavity having an inlet port and an outlet port, said peripheral seals having upper and lower sealing edges, the bottom portion of the sleeve valve forming a single seal with the upper face of the piston section the effective diameter of the single seal being less than the diameter of the lower section of the stepped bore and equal to the diameter of the upper section of the stepped bore, a relief valve situated between the inlet to the said annular cavity and an annular cavity below the piston portion to insure that the pressure in the said annular cavity is greater than the pressure in the cavity below the piston portion and sleeve valve thus effecting the sealing force between the single seal and the upper face of the piston, and the upper edge of the lower peripheral seal and the lower edge of the upper peripheral seals of the sleeve valve being spaced with respect to the inlet port to the annular cavity and the outlet port to the annular cavity so that at the top of the stroke, the inlet port and the outlet port to said annular cavity are simultaneously closed and opened respectively causing a precipitous drop in the pressure in the annular cavity permitting the sleeve valve to move out of sealing relation with the piston portion of said ram thus permitting a bypass of oil from the annular chamber below the piston portion to the annular chamber above the piston portion thus permitting the hammer member to be driven downward.

5. The device of claim 4 where said sleeve valve further includes upper and lower inner radial support surfaces for radially locating said sleeve valve with respect to said ram member.

6. The device of claim 4 wherein said lower annular sealing portion of said sleeve valve comprises a cup-shaped portion having an inside diameter for sealingly engaging the outside diameter of said piston portion.

* * * * *